US009343826B2

(12) United States Patent
Moret Codina

(10) Patent No.: US 9,343,826 B2
(45) Date of Patent: May 17, 2016

(54) ELECTRICAL CONTACT

(75) Inventor: Maria Cristina Moret Codina, Barcelona (ES)

(73) Assignee: SIMON, S.A.U., Barcelona (ES)

( * ) Notice: Subject to any disclaimer, the term of this patent is extended or adjusted under 35 U.S.C. 154(b) by 0 days.

(21) Appl. No.: 14/124,017

(22) PCT Filed: Feb. 14, 2012

(86) PCT No.: PCT/ES2012/000028
§ 371 (c)(1),
(2), (4) Date: Jan. 13, 2014

(87) PCT Pub. No.: WO2012/168503
PCT Pub. Date: Dec. 13, 2012

(65) Prior Publication Data

US 2014/0113509 A1 Apr. 24, 2014

(30) Foreign Application Priority Data

Jun. 8, 2011 (ES) ..... 201130948

(51) Int. Cl.
*H01R 4/48* (2006.01)
*H01R 4/24* (2006.01)

(52) U.S. Cl.
CPC ..... *H01R 4/48* (2013.01); *H01R 4/2433* (2013.01); *H01R 4/4818* (2013.01)

(58) Field of Classification Search
CPC ..... H01R 4/24; H01R 4/4818
USPC ..... 439/861, 404, 410, 409, 395, 417, 816, 439/38
See application file for complete search history.

(56) References Cited

U.S. PATENT DOCUMENTS

| | | | | |
|---|---|---|---|---|
| 4,437,720 | A * | 3/1984 | Harbauer | H01R 4/4827 439/435 |
| 6,012,944 | A * | 1/2000 | Hatakeyama | H01R 4/4818 439/441 |
| 6,254,422 | B1 | 7/2001 | Feye-Hohmann | |
| 6,413,116 | B2 * | 7/2002 | Bechaz | H01R 4/2441 439/395 |
| 6,796,830 | B2 * | 9/2004 | Suss | H01R 4/2466 439/395 |
| 7,431,603 | B1 * | 10/2008 | Szmidt | H01R 4/4836 439/289 |
| 2001/0039139 | A1 * | 11/2001 | Herrmann | H01R 4/2425 439/395 |
| 2008/0280508 | A1 * | 11/2008 | Koellmann | H01R 13/112 439/834 |
| 2009/0215292 | A1 * | 8/2009 | Rueggen | H01R 4/4827 439/83 |
| 2010/0173540 | A1 * | 7/2010 | Lee | F21V 19/0085 439/861 |

(Continued)

FOREIGN PATENT DOCUMENTS

| | | |
|---|---|---|
| JP | 11-238533 | 8/1999 |
| JP | 2000-133335 | 5/2000 |

(Continued)

*Primary Examiner* — Abdullah Riyami
*Assistant Examiner* — Nader J Alhawamdeh
(74) *Attorney, Agent, or Firm* — Michael J. Striker

(57) ABSTRACT

The object of the invention is to provide an electrical contact (1) for a terminal of the "screwless" type which allows connection of electrical conductors (8) both with and without the ends stripped of their insulating sheath (8*a*) due to the special shape of both their contact wall (9), with the ensuing contact edge (10), and their elastic arm (10) disposed before the contact wall (9) with at least one flexion point (12) and forming an angle (a) comprised between 0° and 90° between the two ends of elastic arm (11), additionally, the aforementioned shape allows extension (a) of the cut made by the contact edges (10), thereby breaking the possible thin insulating film that could appear during the cutting operation.

12 Claims, 6 Drawing Sheets

(56) References Cited

U.S. PATENT DOCUMENTS

2012/0264340 A1* 10/2012 Mueller ..... H01R 13/112
439/861

FOREIGN PATENT DOCUMENTS

JP 2001-28277 1/2001
WO 01/78194 10/2001

* cited by examiner

ELECTRICAL CONTACT

CROSS-REFERENCE TO A RELATED APPLICATION

The invention described and claimed hereinbelow is also described in Spanish patent Application P201130948 filed on Jun. 8, 2011. This Spanish Patent Application, whose subject matter is incorporated here by reference, provide the basis for a claim of priority of invention under 35 U.S.C. 119 (a)-(d).

The object of the present invention is an electrical contact for a terminal, specifically of the type known as "screwless", which allows the fast and fully guaranteed connection of electrical conductors. The essential characteristics of said electrical contact are described below.

STATE OF THE ART

At present, two well-differentiated and exclusionary types of electrical contacts are known in the state of the art. These are used to connect electrical conductors using "screwless" type terminals, obliging the end of the electrical conductor to be stripped of its insulating sheath, while the latter have certain cutting elements which, incident upon the surface of the insulating sheath and perforating it, allow contact to be established on the core or conducting element of the electrical conductor.

OBJECT OF THE INVENTION

The object of the invention is to provide an electrical contact which simultaneously enables the two different connection modes of electrical conductors by means of "screwless" terminals, of the type requiring the end of the electrical conductor to be stripped of its insulating sheath and of the type having cutting elements.

Additionally, the shape and design of the cutting zone of the present electrical contact improves cutting of current electrical contacts due to the fact that, as well as cutting until coming into direct contact with the core of the electrical conductor, it extends the cutting zone, breaking the possible thin insulating film that could appear during said cutting operation, thereby avoiding possible false contacts.

GRAPHICAL REPRESENTATION

For the purpose of providing a detailed description of the essential characteristics of the electrical contact object of this invention, drawings are attached wherein, by way of non-limiting example, said electrical contact has been represented, as well as different details of use and practical application thereof. Reference will be made to these drawings throughout the rest of the specification.

In these drawings,

FIGS. 7, 9, 12 show, by means of arrows, the displacement of the central zone of the electrical contact in the different positions of the electrical conductor on being introduced therein;

Figure 1:
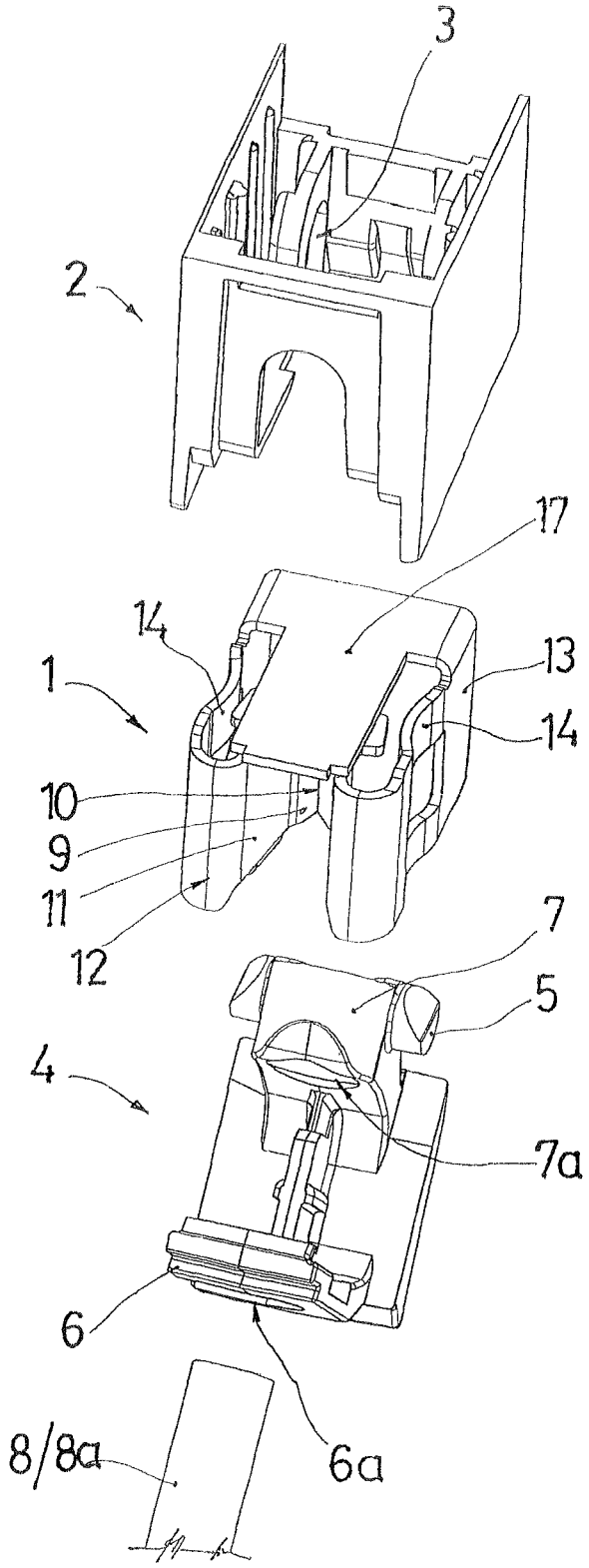
FIG. 1 shows a perspective and exploded view of a screwless terminal, wherein the electrical contact is separated from its housing and its base is disposed on the upper part, together with the positioner of the electrical conductor to be connected.
Figure 2:
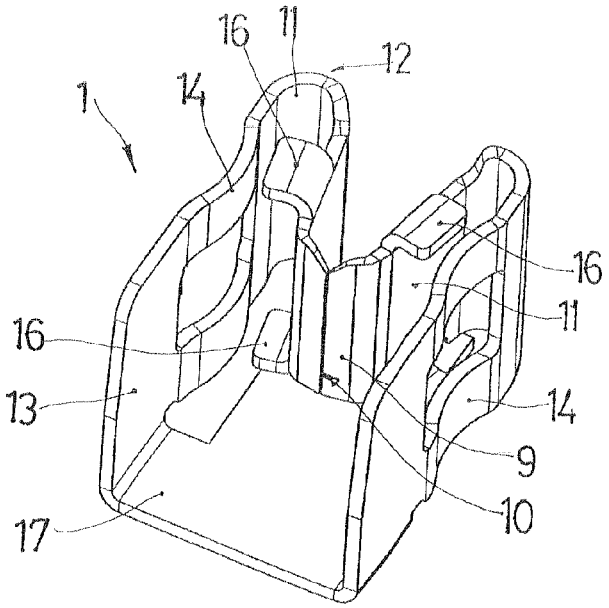
FIG. 2 shows a perspective view of the electrical contact, wherein its body is positioned with its base disposed on the lower part.
Figure 3:
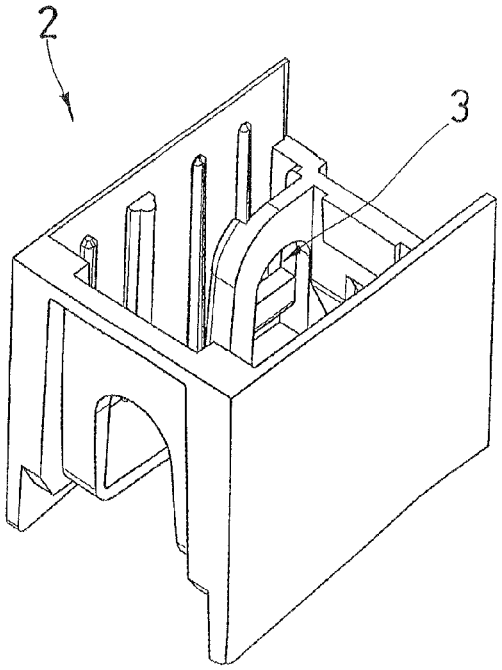
FIG. 3 shows a perspective view of the contact housing, positioned somewhat more sideways than in FIG. 1 in order to show certain details of its interior.
Figure 4:
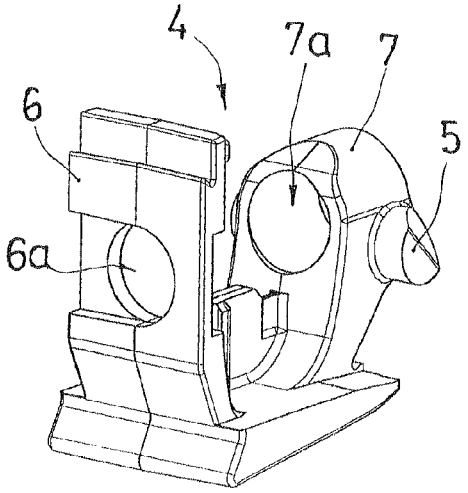
FIG. 4 shows a perspective view of the electrical conductor positioner, shown with a smaller inclination angle than in FIG. 1, also in order to show certain details of its structure.
Figure 5:
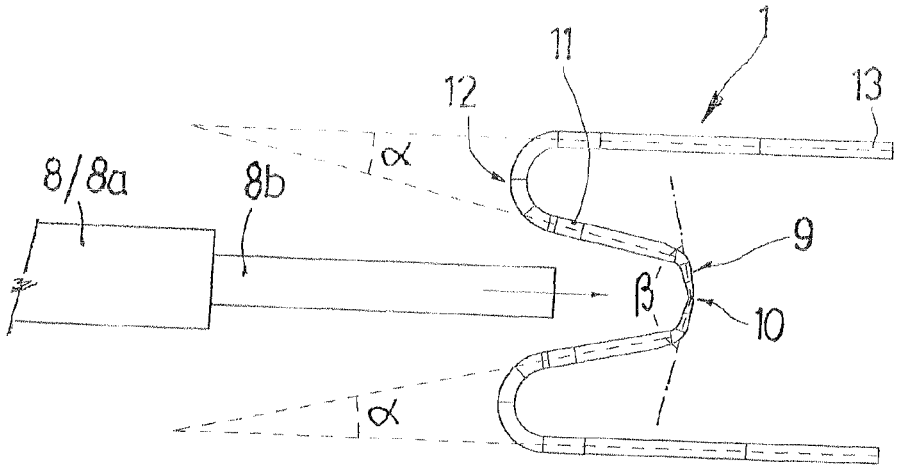
FIG. 5 shows a schematic top plan view of the contact walls of the electrical contact, showing the position and dimensioning of the angles determined by said walls and their edges, also showing the input path of the electrical conductor for connection thereof, in this example an electrical conductor the end of which is stripped of the outer insulating sheath.
Figure 6:
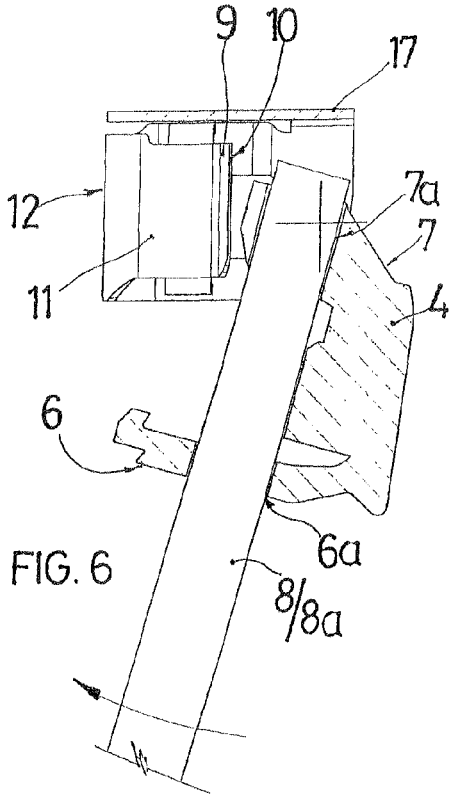
FIG. 6 shows a lateral sectional view of the introduction of the electrical conductor in the interior of the positioner, specifically at the start of the connection operation.
Figure 7:
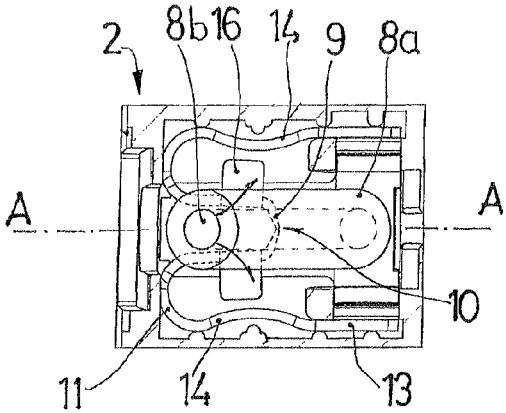
FIG. 7 shows a schematic and top plan view of the positioning of the electrical conductor disposed opposite the electrical contact, according to the preceding figure.
Figure 8:
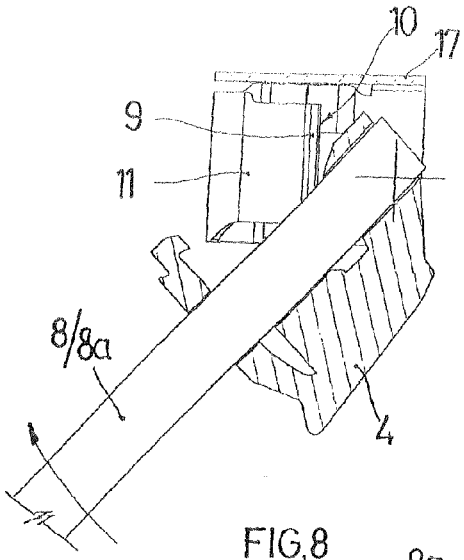
FIG. 8 shows a view corresponding to FIG. 6 in the forward sequence of the connection operation.
Figure 9:
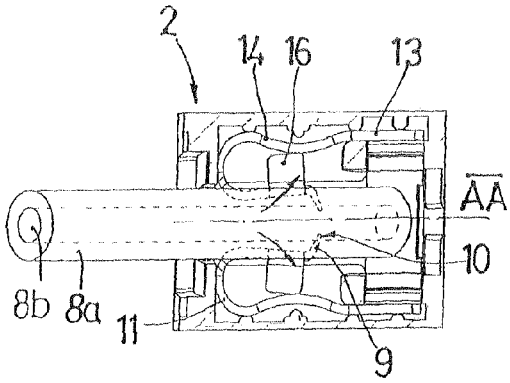
FIG. 9 shows a top plan view corresponding to the positioning of the electrical conductor, according to FIG. 8.
Figure 10:
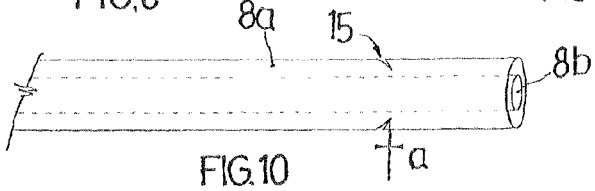
FIG. 10 shows the end of the electrical conductor showing the cuts made by the cutting edges of the electrical contact when the electrical conductor is already in the position of FIG. 8.
Figure 11:
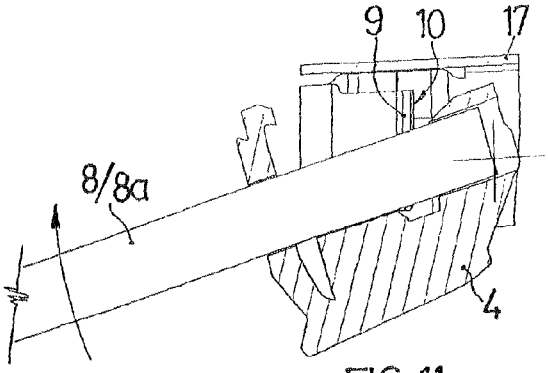
FIG. 11 shows a view corresponding to FIGS. 6 and 8 in the forward sequence of the connection operation at the precise instant when the electrical contact reaches the core of the electrical conductor.
Figure 12:
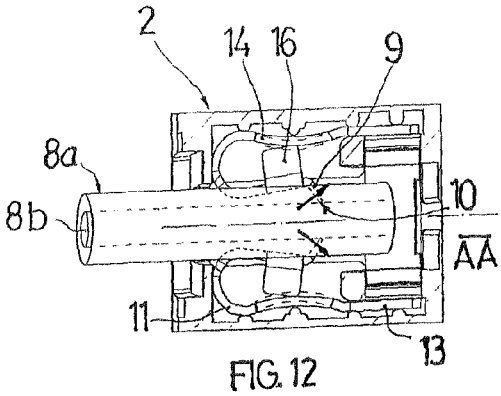
FIG. 12 shows a top plan view corresponding to the positioning of the electrical conductor, according to FIG. 11.
Figure 13:
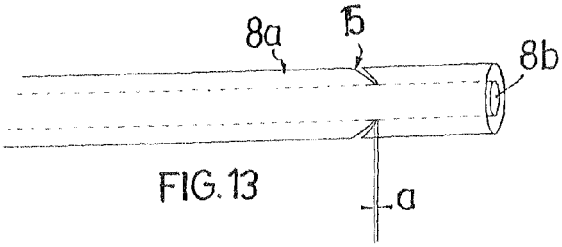
FIG. 13 shows the end of the electrical conductor with the cuts made in the position of FIG. 11, also showing, in addition to the increased cut, the extension thereof.
Figure 14:
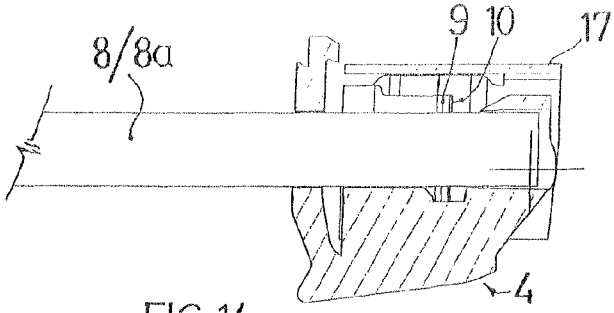
FIG. 14 shows a view corresponding to FIGS. 6, 8 and 11 in the forward sequence of the connection operation and at the final instant of connection.
Figure 15:
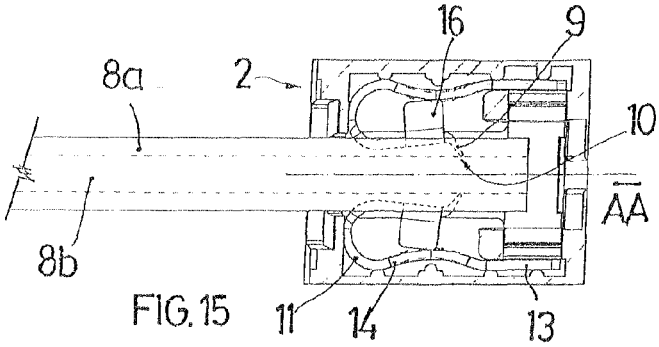
FIG. 15 shows a top plan view corresponding to the final positioning of the electrical conductor, according to FIG. 14.
Figure 16:
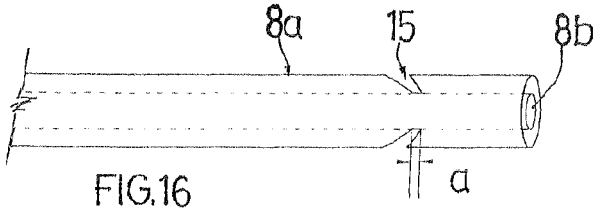
FIG. 16 shows the end of the electrical conductor with the final cuts and extensions made by the cutting edges in their final position.
Figure 17:
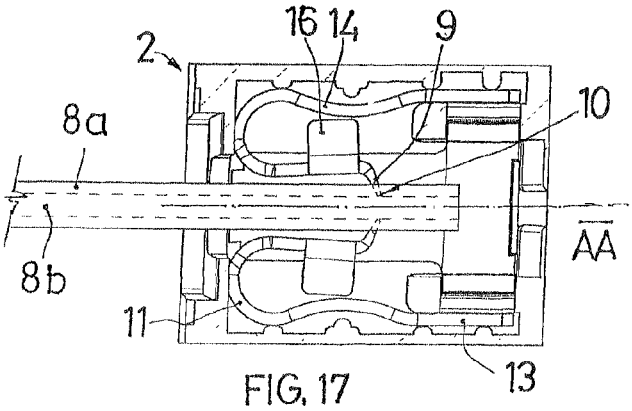
FIG. 17 shows a top plan view according to the positioning of FIG. 15, in an application with an electrical conductor of smaller diameter to that represented in the preceding figures.
Figure 18:
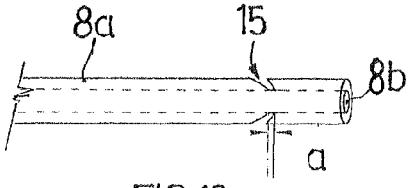
FIG. 18 shows a view corresponding to FIG. 16, showing the final cuts and extensions thereof made in an electrical conductor of smaller diameter, according to FIG. 17.
Figure 19:
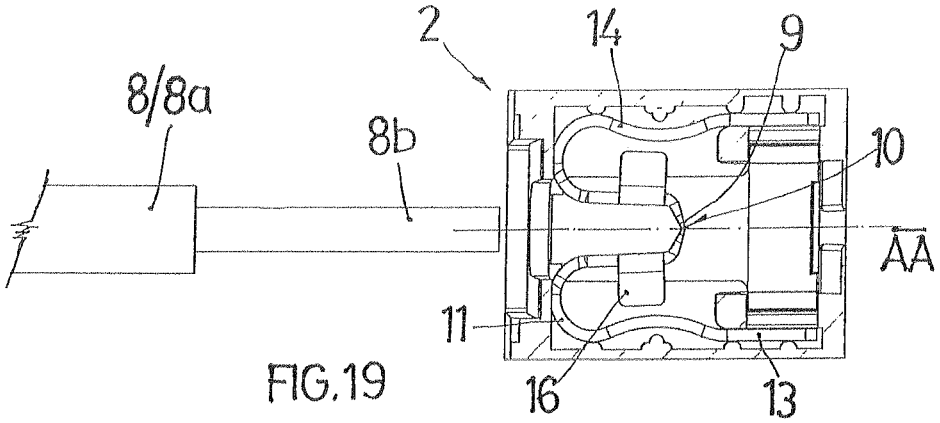
Figure 20:
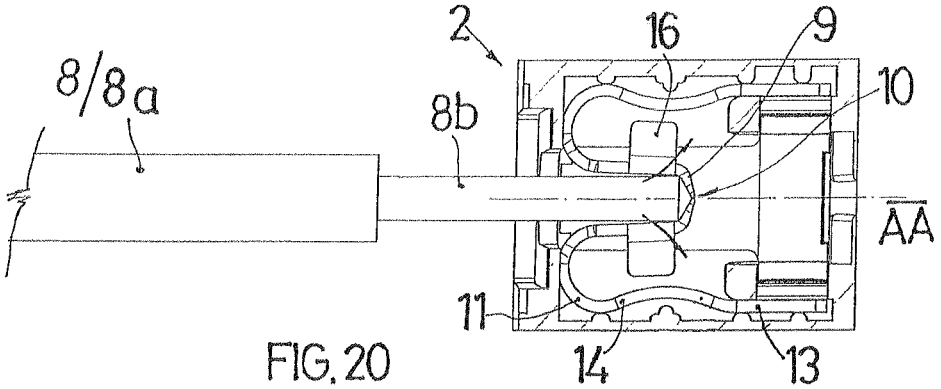
Figure 21:
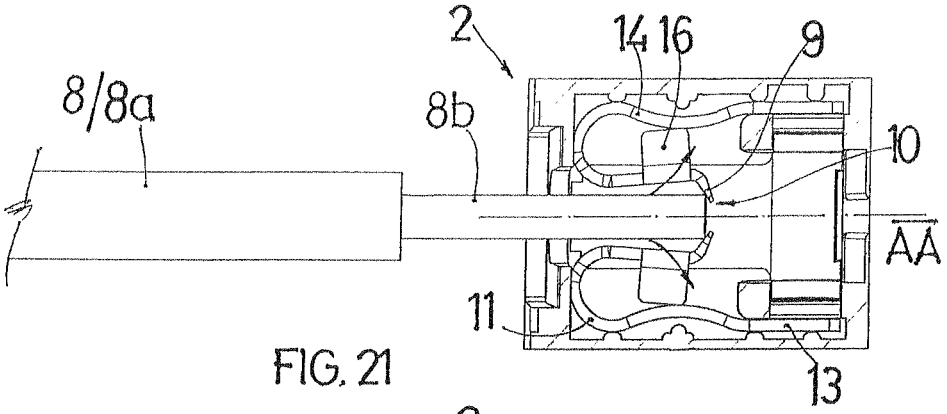
Figure 22:
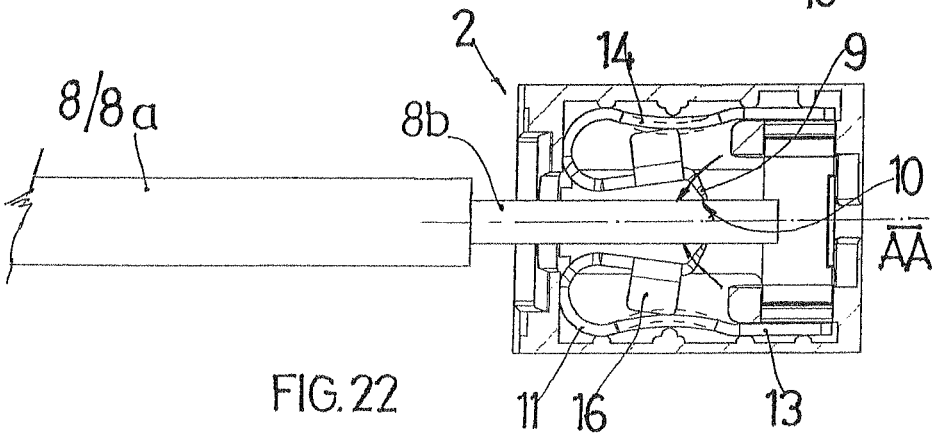

FIGS. 19 to 22 show the introduction and fixation sequence in the interior of the electrical contact of an electrical conductor, in the application variant wherein the end is stripped of its outer insulating sheath. The movement and action of the cutting edges of the electrical contact, as the end of the electrical conductor is positioned, have been represented in FIGS. 20 to 22 by means of arrows;

FIG. 19 shows the starting position of the forward sequence of the connection operation;

FIG. 20 shows a view corresponding to FIG. 19 in the forward sequence of the connection operation at the precise instant when the electrical conductor reaches the electrical contact;

FIG. 21 shows a view corresponding to FIGS. 19 and 20 in the forward sequence of the connection operation showing the electrical conductor starting to pass through the electrical contact; and FIG. 22 finally, shows a view corresponding to FIGS. 19, 20 and 21 in the final position of the forward sequence of the connection operation, showing the fixation pressures exerted by the electrical contact in relation to the electrical conductor.

DESCRIPTION

In accordance with the figures, an embodiment of the electrical contact -1-, according to the present invention, comprises two side walls -13- which extend into corresponding elastic arms -11- having at least one flexion point -12-, each forming an angle "α" having a value between 0° and 90° between the two ends of the aforementioned elastic arms -11- and which, in turn, extend into corresponding contact walls -9-, each having a rim that constitutes the contact edge -10- on an electrical conductor -8- to be connected.

The side walls -13- are partially joined together by means of a base -17- the elongated shape of which reaches up to the height of the contact walls -9- without being joined thereto. Additionally the side walls -13- have corresponding concave flanges -14- in their central zone towards the interior of the electrical contact -1- itself.

Projections by way of horizontal tabs -16- disposed at the same height as the flanges -14- are disposed between the flexion point -12- and the contact walls -9- on the upper and lower edges of the elastic arms -11-.

The contact walls -9- are disposed forming a certain "β" angle between 0° and 180°, concave in relation to the insertion direction of the electrical conductor -8- to be connected. Additionally, the lower part of the contact walls -9- opposite the zone where the base -17- is disposed are rounded in the direction of the corresponding contact edge -10- to help the introduction of the electrical conductor -8- between said contact edges -10- which are sharp.

In the practical case of introduction of the electrical conductor -8- with its insulating sheath **-8*a*-, the electrical contact -1- is positioned in the interior of its housing -2-, which has lateral openings -3- where the cable positioner -4- is disposed through its lateral stubs -5- and rotation axis. The positioner -4- has two circular orifices -6*a*- on its front part -6-, and -7*a*- on its rear part -7-, where the end of the electrical conductor -8-** is housed to perform the rotational connection movement.

Once the electrical conductor -8- has been introduced in the positioner -4-, both start a rotational movement, as shown sequentially in the figures, to connect the electrical conductor -8- inside the electrical contact -1-.

In order to improve introduction of the electrical conductor -8- in the electrical contact -1-, the electrical conductor -8- enters the electrical contact -1- through the rounded zone of the contact walls -9- which guide it towards the contact edges -10-. In order to avoid the possible flexion of the contact walls -9- in the direction of rotation, the base -17- acts as a stop for said contact walls -9-.

During the rotational movement, once the electrical conductor -8- is in contact with the cutting edges -10-, these start the out -15- to the insulating sheath **-8*a*- of the electrical conductor -8- while, in turn, the unit formed by the contact walls -9- and the parts of the elastic arms -11- which are disposed between the flexion point -12- and the contact wall -9- flex towards the side walls -13-, achieving extension -a- of the cut -15-**.

Once the contact edges -10- reach the core **-8*b*- of the electrical conductor -8-, the contact walls -9- themselves also flex towards the side walls -13-, increasing the extension action -a- of the cut -15-**.

Once the rotation movement is completed, the flexion accumulated in the elastic arms -11- guarantees fixation of the contact edges -10- on the core **-8*b*- of the electrical conductor -8-, and the extension -a- of the cut achieved during rotation guarantees breakage of the possible thin films of the insulating sheath -8*a*-**, thereby avoiding false contacts on account of said thin insulating films.

In order to house electrical conductors -8- having different diameters and different insulating layer **-8*a*- thicknesses in the same-sized terminal, the elastic arm -11- has horizontal tabs -16- which, once the electrical conductor -8- to be connected has a large diameter, the horizontal tabs -16- collide with the flanges -14- of the side walls -13-, achieving greater cutting force on the cutting edges -10-**.

In the practical embodiment wherein the electrical conductor -8- is introduced into the electrical contact -1- with its end stripped of the protective sheath **-8*a*-, as represented in the sequence illustrated in FIGS. 19 to 22, on one hand, the presence of the positioner -4- or the base -17- would not be necessary and, on having the contact walls -9- a concave angle -β- in the insertion direction of the electrical conductor -8-, the insertion action itself of the electrical conductor -8- on the contact walls -9- causes the opening by flexion towards the side walls -13- of the unit formed by the contact walls -9- and the parts of the elastic arms -11- which are disposed between the flexion point -12- and the contact wall -9-. Once the electrical conductor -8- is connected, the flexion accumulated in the elastic arms -11- guarantees fixation of the contact edges -10- on the core -8*b*- of the electrical conductor -8-**.

Having sufficiently described the object of the present invention, it must be pointed out that any variation in dimensions, shape and outer appearance, as well as the materials used in the practical embodiment of the electrical contact -1- to which reference has been made, will not alter the essentiality thereof whatsoever, which is summarised in the following claims.

The invention claimed is:

1. An electrical contact (1) for a terminal of a screwless type for connecting electrical conductors, comprising:

a base (17) having a two opposing sides a two opposing sidewalls (13), each of the opposing sidewalls (13) extends from each of the two opposing sides (13) of the base (17);

each of the opposing sidewalls (13) comprising:

a contact wall (9) having a contact edge (10) with single electrical conductor (8) to be connected, and an elastic arm (11) having opposing first and second ends, wherein the elastic arm (11) disposed before and connects to the contact wall (9) at the first end, having a flexion point (12) connects to the second end and the opposing sidewalls (13), the elastic arm (11) forming an angle (α) comprised between 5° and 35° between the opposing first and second ends of said elastic arm (11), wherein the second end of the elastic arm (11) extends from the opposing sidewall (13), and wherein the contact wall (9) is disposed obliquely forming an angle (β/2) comprised between 50° and 90° in relation to an axial axis of the single electrical conductor (8).

2. The electrical contact (1), according to claim 1, wherein the contact wall (9) and the elastic arm (11) disposed before the contact wall (9).

3. The electrical contact (1), according to claim 2, wherein the contact wall (9) is disposed obliquely in relation to the axial axis of the single electrical conductor (8).

4. The electrical contact (1), according to claim 3, wherein the angle formed between the contact wall (9) and the axial axis of the single electrical conductor (8) is concave in an insertion direction of the single electrical conductor (8) into the electrical contact (1).

5. The electrical contact (1), according to claim 1, wherein an angle (β) formed by the two contact walls (9) therebetween is less than 180°.

6. The electrical contact (1), according to claim 5, wherein the angle (β) formed by the two contact walls (9) is concave in an insertion direction of the single electrical conductor (8) into the electrical contact (1).

7. The electrical contact (1), according to claim 1, wherein a contact edge (10) of each contact wall (9) is sharp.

8. An electrical contact (1) for a terminal of a screwless type for connecting electrical conductors, comprising:

a base (17) having a two opposing sides a two opposing sidewalls (13), each of the opposing sidewalls (13) extends from each of the two opposing sides (13) of the base (17);

each of the opposing sidewalls (13) comprising:

a contact wall (9) having a contact edge (10) with a single electrical conductor (8) to be connected, and an elastic arm (11) having opposing first and second ends, wherein the elastic arm (11) disposed before and connects to the contact wall (9) at the first end, having a flexion point (12) connects to the second end and the opposing sidewalls (13), the elastic arm (11) forming an angle (α) comprised between 5° and 35° between the opposing first and second ends of said elastic arm (11), wherein the contact wall (9) is disposed obliquely forming an angle (β/2) comprised between 50° and 90° in relation to an axial axis of the single electrical conductor (8), wherein the elastic arm (11) comprises a projection (16) near a base of the contact walls (9), wherein the elastic arm (11) extends along from the second end into the sidewalls (13), and wherein the sidewalls (13) comprise a concave flange (14) towards an interior of the electrical contact (1), disposed in opposition to the projection (16) of the elastic arm (11).

9. The electrical contact (1), according to claim 1, wherein a contact zone between the electrical single conductor (8) and the contact walls (9), when the electrical single conductor (8) is connected, is rounded in a direction of the contact edge (10) and, by way of a stop against the contact walls (9), the base (17) is formed on an opposite side of the rounded zone of the contact walls (9).

10. An electrical terminal which comprises the electrical contact (1), according to claim 1.

11. An electrical device which comprises the electrical contact (1), according to claim 1.

12. An electrical device which comprises the electrical terminal of claim 10.

* * * * *